United States Patent [19]

Ito

[11] 4,230,077

[45] Oct. 28, 1980

[54] VACUUM OPERATED SERVO

[75] Inventor: Tomo Ito, Katsuta, Japan

[73] Assignee: Hitachi, Ltd., Japan

[21] Appl. No.: 936,126

[22] Filed: Aug. 23, 1978

[30] Foreign Application Priority Data

Aug. 25, 1977 [JP] Japan ..... 52-102042

[51] Int. Cl.[3] ..... F02D 11/08

[52] U.S. Cl. ..... 123/389; 123/198 DB; 123/DIG. 11; 123/378; 123/360; 91/395

[58] Field of Search ..... 123/103 R, 103 E, 198 DB, 123/DIG. 11; 251/29, 61.2; 91/47, 395

[56] References Cited

U.S. PATENT DOCUMENTS

| | | | |
|---|---|---|---|
| 2,077,515 | 4/1937 | Campbell | 251/29 |
| 3,072,108 | 1/1963 | Cripe | 91/395 |
| 3,322,227 | 5/1967 | Thorner | 123/103 R |
| 3,370,577 | 2/1968 | Guetersloh et al. | 123/103 R |
| 3,381,582 | 5/1968 | Golden | 91/395 |
| 3,659,499 | 5/1972 | Woodward | 123/103 R |
| 3,744,471 | 7/1973 | Braun et al. | 123/103 R |
| 3,752,141 | 8/1973 | Charron et al. | 123/103 R |
| 3,760,785 | 9/1973 | Harrison et al. | 123/103 R |

*Primary Examiner*—Ira S. Lazarus

*Attorney, Agent, or Firm*—Craig & Antonelli

[57] ABSTRACT

A vacuum operated servo comprises a vacuum chamber defined by a flexible diaphragm and a cover, a valve seat secured to the cover so as to project into the vacuum chamber, a valve body yieldably mounted on the flexible diaphragm, a first vacuum conduit with a first valve for inducing vacuum from a vacuum source into the vacuum chamber through the valve seat, a second vacuum conduit with a second valve for inducing vacuum from the vacuum source into the vacuum chamber, and a leak orifice for leaking the vacuum in the vacuum chamber. When the first valve is opened to induce vacuum of the vacuum source into the vacuum chamber, by the vacuum, the diaphragm is moved so that the valve body contacts with the valve seat. Upon the contact, the induction of the vacuum is interrupted to stop the movement of the diaphragm, with the vacuum being introduced and leaked out of the vacuum chamber. When the second valve is opened to induce the vacuum of the vacuum source into the vacuum chamber, the vacuum moves the diaphragm to contact a stopper provided on the diaphragm with the cover irrespective of operation of the first valve. Therefore the vacuum operated servo provides a plurality of positions.

9 Claims, 2 Drawing Figures

VACUUM OPERATED SERVO

BACKGROUND OF THE INVENTION

This invention relates to a vacuum operated servo, particularly to a vacuum operated servo using a diaphragm suitable for throttle positioning of a carburetor.

It is desirable that one vacuum operated servo can provide various positions because it has small space needed for its installation and its manufacture may bear a low cost. As this kind of servo, known is a servo used for throttle valve positioning which is described in Japanese Laying-open for Patent Application No. 51423/1974 and Japanese Patent Publication No. 35971/1975.

The servo has first and second chamber divided by a partition with an orifice, each of which chambers is provided a flexible diaphragms thereby to divide the chamber into two, vacuum and air chambers, so that the vacuum chamber of the first chamber will be in a back to back relation with the vacuum chamber of the second chamber. The diaphragms of the first and second chambers each have a plunger secured thereto at their central portions. The first plunger of the first chamber projects slidably through a hole made in the partition into the vacuum chamber of the first chamber, the second plunger of the secnd chamber projects out of the second chamber to contact with a throttle lever of a carburetor, which lever is mechanically connected to a throttle valve to control the opening of the throttle valve. The vacuum chamber of the first chamber communicates with an air-fuel induction passage downstream of the throttle valve, and further with the vacuum chamber of the second chamber through the orifice of the partition.

The servo provides three positions for the throttle valve, namely, a starting position, a curb idle position and antidieseling position through sliding movement of the plunger according to vacuum in the vacuum chambers.

A sliding portion in which the sliding movement is effected should be precisely finished, and sealed airtightly. This realing for the sliding portion is difficult because it is necessary to seal without having any effect on the sliding movement. Further in the sealed sliding portion, the plunger which is slidably moved by the diaphragm has a danger such that the plunger may stick to the hole of the partition.

Therefore, desired is a servo for providing a plurality of positions without the above-mentioned sliding portion and sealing means of the sliding portion.

SUMMARY OF THE INVENTION

An object of the invention is to provide an vacuum operated servo which is simple in construction, stable in operation, and able to provide a plurality of positions.

Another object of the invention is to provide an vacuum operated servo with a single diaphragm which is simple in construction, stable in operation and able to provide a plurality of throttle openings of a carburetor.

Briefly stated, a feature of the invention is that an expansible vacuum chamber including a diaphragm and a plurality of vacuum induction means to interrupt vacuum supply from the closed vacuum induction means into the expansible vaccum chamber when the expansible vacuum chamber shrinked by a predetermined value, and further can shrink when another vacuum induction means induces vacuum into the expansible vacuum chamber.

DESCRIPTION OF THE PREFERRED EMBODIMENTS

Figure 1:
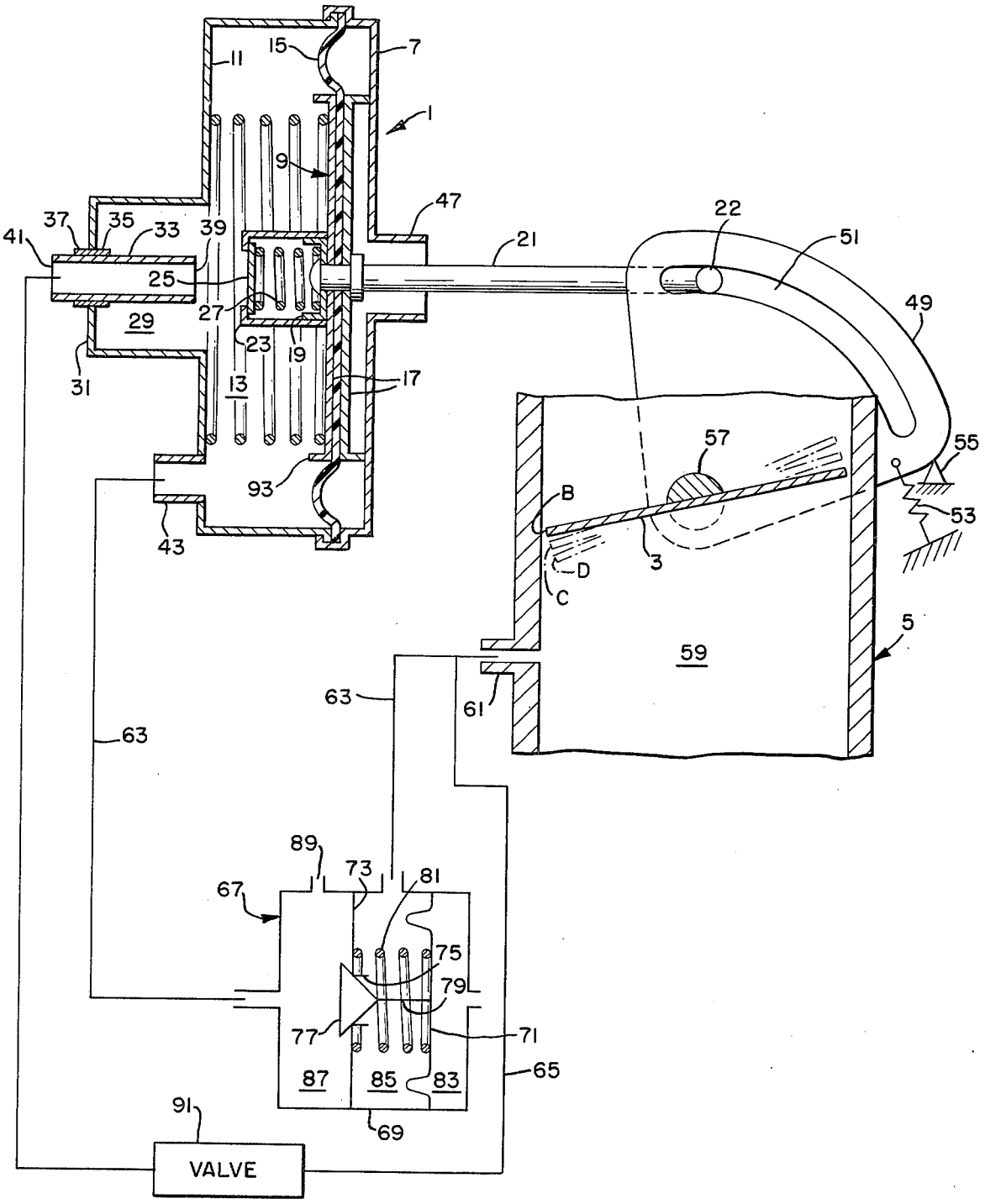
FIG. 1 is a sectional view of an embodiment of a vacuum operated servo according to the invention and a part of a carburetor.

Referring to FIG. 1, an embodiment of the invention will be described in detail hereinafter. FIG. 1 shows an vacuum operated servo 1 which is adapted for controlling a throttle valve 3 of a carburetor 5 for automobiles.

In FIG. 1, the servo 1 comprises a case 7, a diaphragm assembly 9, and a cover 11. The diaphragm assembly 9 is held air-tightly at its periphery by the case 7 and the cover 11 carried by the case 7 to secure thereby define a vacuum chamber 13. The diaphragm assembly 9 includes a flexible diaphragm 15, a pair of retainers 17 holding a central portion of the diaphragm 15, a cup-shaped bracket 19. All of the diaphragm 15, the pair of retainers 17 and the cup-shaped bracket 19 have a hole in their center, and are assembled by inserting one end of a rod 21 into the holes and rivetting the end. On the cylindrical portion of the bracket 19, a cylindrical holder 23 is rigidly inserted. The holder 23 holds a valve body 25 of a metal plate with help of a spring 27 pressing the valve body 25 to the holder 23. The cover 11 projects outside at the central portion (leftside in the drawing) to provide a recess portion 29 in the vacuum chamber 13. In the projection portion 31 of the cover 11, a threaded hold is made and a metal nipple 33 with a thread portion is inserted in the threaded hole to be secured to the cover 11. The length of the nipple 33 projecting into the vacuum chamber 13 is adjusted by rotation of the nipple 33. The thread portion 35 is sealed by means such as a sealing wax 37 adhered thereto. The end 39 of the nipple 33 projecting into the vacuum chamber 13 forms a valve seat. The valve seat 39 and the valve body 25 provide a valve means for controlling a vacuum passage 41. The cover 11 further is provided with a nipple 43 secured thereto air-tightly by means such as welding. In the vacuum chamber 13, a spring 45 is disposed to expand the chamber 13. The diaphragm assembly 9 urged rightward of the drawing by the spring 45 is stopped by the casing 7. The casing 7 has a hole 47 at its central portion, and the rod 21 extends rightward of the drawing through the hole 47.

The rod 21 is engaged with a throttle lever 49 of the carburetor 5 at a claw 22 formed on one end. The claw 22 is loosely inserted in an arc-shaped groove 51. The throttle lever 49 is pulled rightward by a spring 53 to contact with a stopper 55. The throttle valve 3 is secured to a shaft 57 which is secured to the throttle lever 49 so that the throttle valve 3 will be rotated by the throttle lever 49.

In a side wall of a fuel-air induction passage 59 downstream of the throttle valve 3, a nipple 61 is provided. The fuel-air induction passage 59 communicates with the vacuum chamber 13 through vacuum conduits 63, 65. On the vacuum conduit 63, a control valve 67 is mounted. The control valve 67 comprises a casing 69, a flexible diaphragm 71 the periphery of which is secured to the casing 69, a partition 73 the periphery of which is secured to the casing 69, and the central portion of which has a valve seat 75, a valve body 77 connected to the diaphragm 71 by a stem 79, and a spring 81 disposed between the partition 73 and the diaphragm 71 to close a vacuum passage defined by the valve seat 75 and the valve body 77. The diaphragm 71 and the partition 73 divide the interior of the casing three chambers, that is air chamber 83 communicating with the atmosphere, and vacuum chambers 85, 87. On the vacuum chamber 87, a leak orifice 89 is provided to communicate it with the atmosphere. On the vacuum conduit 65, a 2-way valve 91 is provided. The valve 91 closes or opens the vacuum conduit 65, synchronism with on-off of a compressor for a cooler (not shown).

In idling operation in which the cooler compressor is not operated, the throttle valve 3 is opened to a position indicated by B. The throttle valve position B is provided by contacting the throttle lever 49 with the stopper 55 by pulling it by the spring 53. In the idling operation, when the cooler compressor is operated, that is the 2-way valve 91 is opened to induce vacuum in the fuel-air induction passage 59 into the vacuum chamber 13 of the servo 1. The diaphragm assembly 9 is moved leftward by the vacuum induced until the valve body 25 contacts with the end 39 of the nipple 33 serving as a valve seat. When the valve body 25 contacts with the valve seat 39, the vacuum conduit 65 is closed its stop the leftward movement of the diaphragm assembly 21. The vacuum in the vacuum chamber 13 is lowered because air is introduced into the vacuum chamber 13 through the leak orifice 89. Upon the introduction of air, the valve body 25 is moved rightward and separated from the valve seat 39 to again induce vacuum into the vacuum chamber 13, so that the diaphragm assembly 9 is again moved leftward to stop when the valve body 25 closes the vacuum conduit 65 with the valve seat 39 being contacted with the valve body 25. Thus on-off operation of the valve of the valve seat 39 and valve body 25 is repeated automatically to maintain a throttle position C, that is a fast idle opening of the throttle valve.

When an engine is decelerated, that is vacuum in the fuel-air induction passage 59 is larger than a predetermined value such as −550 mmHg, the control valve 67 is opened, with the diaphragm 71 being moved leftward by vacuum introduced in the vacuum chamber 85 from the fuel-air induction passage 59 to open the vacuum passage defined by the valve seat 75 and valve body 77. The vacuum in the fuel-air induction passage 59 is induced into the vacuum chamber 13 of the servo 1 through the vacuum conduit 63. The diaphragm assembly 9 is moved toward the cover 11 until a stopper portion 93 of the diaphragm assembly 9 contacts with the cover 11 opposite to the stopper portion 93. At this time, the valve body 25 is displaced toward the bracket 19 by the nipple end 39. This diaphragm assembly position provide the throttle valve 3 with a throttle valve position or opening D (which is called throttle opener opening). At this time, the vacuum in the vacuum chamber 13 and stroke of the diaphragm assembly 9 are not changed irrespective of the operation of the cooler compressor, that is closing or opening of the 2-way valve 91, because the vacuum conduit 65 is closed at the end 39 of the nipple 41.

Diameter of the leak orifice 89 is preferably 0.8 mm. It is noted that the leak orifice 89 can be provided on any portion of the vacuum chamber 13 or 87 or the vacuum conduit 63 between the vacuum chambers 13 and 87.

Thus constructed vacuum operated servo 1 has no sliding portion so that its operation is stable, and is simple in construction. The vacuum operated servo 1 adapted for throttle positioning of an engine carburetor can provide the throttle valve 3 with a fast idling position for operation of the cooler compressor whereby the throttle opening is automatically controlled and a defect that engine load due to operation of the compressor is increased so that the engine is stopped can be avoided. Further since the throttle valve 3 is automatically controlled according to the vacuum downstream of the throttle valve a really necessary amount of fuel-air mixture is supplied into the engine so that the engine can maintain a good combustion condition thereby decreasing an amount of HC in the exhaust gas and effecting fuel-saving.

It is noted that even if the vacuum in the vacuum chamber 13 leaks from the valve means comprising the valve body 25 and valve seat 39, a constant throttle valve position can be obtained since the vacuum in the vacuum chamber 13 leaks through the leak orifice 89. Therefore, it is not necessary to bring the valve seat 39 and the valve body 25 into a air-tight contact.

Figure 2:
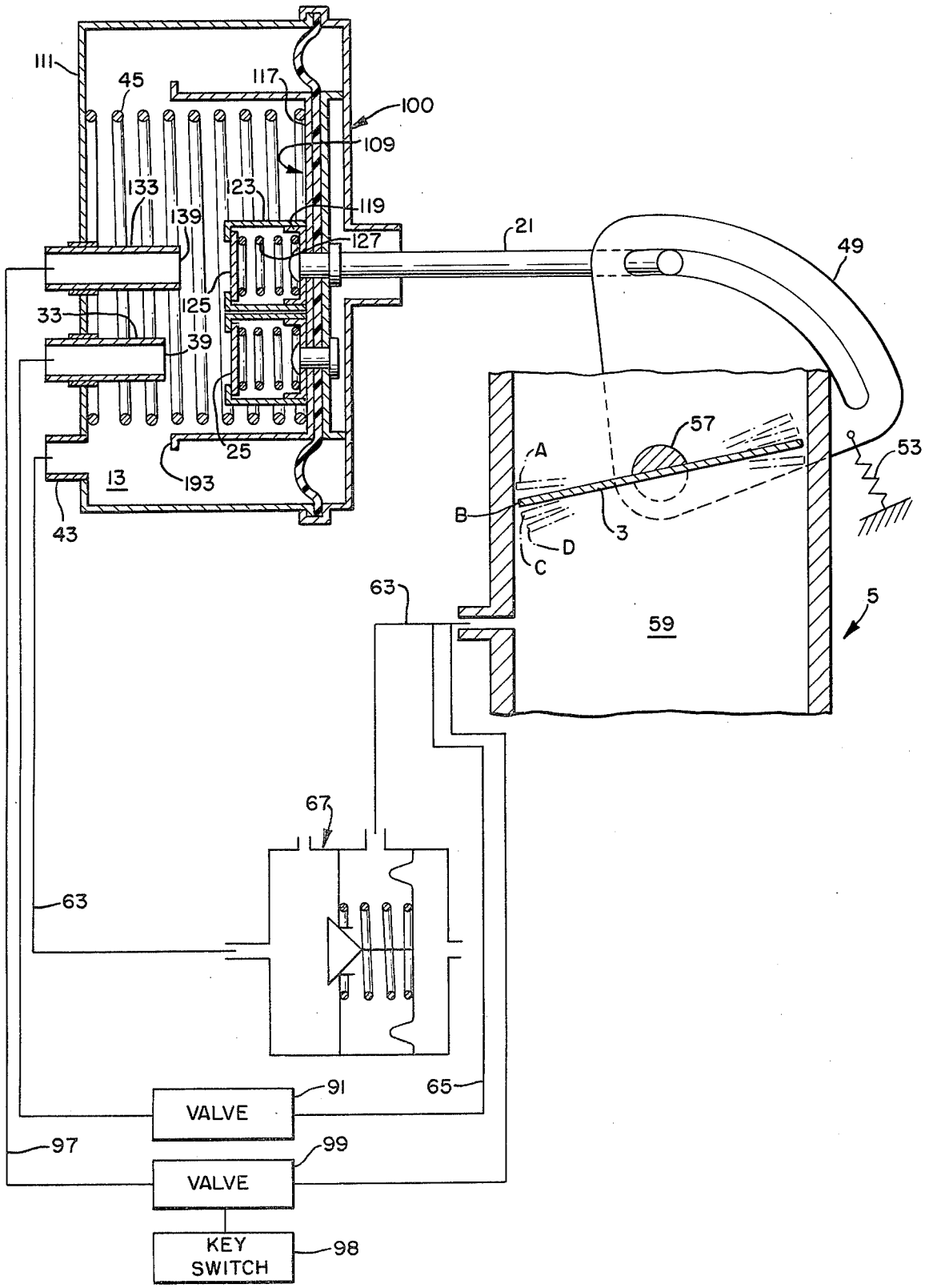
FIG. 2 is a sectional view of another embodiment of a vacuum operated servo according to the invention and a part of a carburetor.

Referring to FIG. 2, another embodiment of a vacuum operated servo according to the invention will be described hereinafter in detail.

In FIG. 2, a vacuum operated servo 100 adapted for controlling a throttle valve 3 of a carburetor 5 is shown, and units or parts having the same functions as ones in FIG. 1 are shown by the same reference numerals or characters. Only different portions from FIG. 1 will be described hereinafter.

The carburetor 5 has no stopper for the throttle lever 49 such as the stopper 55 in FIG. 1. The servo 1 comprises a diaphragm assembly 109 which is the same function as one in FIG. 1 except for having another valve body 125 held by a compression spring 127 and a holder 123 secured on a cylindrical bracket 119 rivetted with an end of a rod 21, and another valve seat 139 or end of a nipple 133 secured to a cover 111 in the same manner as the nipple 33 in FIG. 1. A valve body 25 is spaced from a retainer 117 by about the same distance as the valve body 125. Distance between the valve body 125 and the valve seat 139 is smaller than that between a valve body 25 and a valve seat 39 of an end of a nipple 33 secured to the cover 111. The nipple 133 is connected to a vacuum conduit 97 providing a valve 97 thereon to communicate between a vacuum chamber 13 and a fuel-air induction passage. The valve 99 is electrically connected to a key switch 98 of the engine so that when the key switch 98 is made 'on', the valve 99 is opened, and when the key switch is made 'off', the valve 99 is closed.

When the key switch 98 is 'off', vacuum is not established in a fuel-air induction passage 59, so that the throttle valve 3 is fully closed as shown by A, with a throttle lever 49 being pulled by a spring 53. When the key switch 98 is turned 'on' to open the valve 9, the engine is cranked to establish vacuum in the fuel-air induction passage 59, and the vacuum is induced in the vacuum chamber 13. By the vacuum, the diaphragm assembly 109 is moved toward the valve seat 139, which accompanies rotation of the throttle lever 49 and the throttle valve 3 to open. When the valve body 125 contacts with the valve seat 138, the vacuum conduit 97 is closed, and the diaphragm assembly 109 stops so that the throttle valve 3 maintains a position B or an idling position. In this condition, when a compressor cooler (not shown) is operated, a 2-way valve 91 is opened so that the vacuum in the fuel-air induction passage 59 is induced into the vacuum chamber 13 through a vacuum conduit 65. By the vacuum, the diaphragm assembly 109 is further moved leftward of the drawing until the valve seat 39 contacts with the valve body 25. Upon the contact, the vacuum induction is interrupted to stop the movement of the diaphragm assembly 109 so that the throttle valve 3 rotating anticlockwise is stopped at a throttle position C which is a fast idling position.

Further, when the engine running for example at a rated speed is decelerated, a control valve 67 is opened by a high vacuum of for example-550 mmHg which is established in the fuel-air induction passage 59 downstream of the throttle valve 3, and the vacuum is induced into the vacuum chamber 13 through a vacuum conduit 63. By the vacuum, the diaphragm assembly 109 is moved leftward until a stopper portion 193 of the diaphragm assembly 109 contacts with the cover 111, whereby the throttle valve 3 is open at a position D.

Thus, the vacuum operated servo 100 can provide the throttle valve 3 with a plurality of positions.

It is apparent that the vacuum operated servo 1 or 100 can be used for various throttle positionings for example for running an engine with supplementary apparatus, various fast idling operation in a cold weather and a throttle opening for purifying an exhaust gas other than used for the throttle positioning for torque compensation for driving the cooler compressor as described in FIGS. 1 and 2.

What is claimed is:

1. A vacuum operated servo comprising:

an expansile vacuum chamber;

a flexible diaphragm means defining a part of said expansible vacuum chamber;

open valve means disposed in said vacuum chamber and including a valve body and a valve seat, said valve body being yieldably mounted on said flexible diaphragm means, said valve seat being mounted on a side of said expansible vacuum chamber toward which said flexible diaphragm means is displaceable under action of vacuum supplied to said vacuum chamber, and said open valve means being closed when said flexible diaphragm means is displaced a first predetermined distance;

stopper means associated with said flexible diaphragm means for stopping said flexible diaphragm means when said flexible diaphragm means is displaced a second predetermined distance by said vacuum action, said second predetermined distance being greater than said first predetermined distance;

a first vacuum passage means with a valve means connected between said seat of the open valve means and a vacuum source for communicating the interior of said expansible vacuum chamber with the vacuum source through said open valve means;

a control valve comprising a casing, a diaphragm, the periphery of which is secured to said casing thereby providing a control valve vacuum chamber, a partition disposed in said control valve vacuum chamber for dividing same into first and second vacuum chambers, and a closed valve means including a valve seat provided in said partition and a valve body secured to the diaphragm of the control valve so that said closed valve is opened when a pressure in said first vacuum chamber reaches a predetermined value, and a leak orifice means provided on said second vacuum chamber for introducing air from the atmosphere into said second chamber;

a second vacuum passage means connected to the interior of said expansible vacuum chamber and the second vacuum chamber of said control valve; and a third vacuum passage means connected to said first vacuum passage means and the vacuum source.

2. The vacuum operated servo as defined in claim 1, wherein said valve body is a plate yieldably mounted on said diaphragm means, and said valve seat is an end of a nipple secured to a cover forming part of said expansible vacuum chamber so as to project into said expansible vacuum chamber.

3. The vacuum operated servo as defined in claim 1, further including another open valve means disposed in said vacuum chamber, and a third vacuum passage means with a third vacuum valve means for communicating said vacuum chamber with the vacuum source through said open valve means.

4. The vacuum operated servo as defined in claim 1 or 2, wherein said first and third vacuum passage means each are connected to a fuel-air induction passage of a carburetor downstream of a throttle valve.

5. The vacuum operated servo as defined in claim 4, further including means mechanically connected to said flexible diaphragm means and said throttle valve for transmitting the movement of said flexible diaphragm means to said throttle valve.

6. A vacuum operated servo comprising:

a casing;

a cover member for forming a housing in cooperation with said casing;

a flexible diaphragm assembly disposed in said housing and secured to said housing at its periphery for defining an expansible chamber in cooperation with said cover member;

a bias spring disposed in said expansible chamber for expanding said expansible chamber;

a valve body formed by a metal plate yieldably mounted on said flexible diaphragm assembly so as to be disposed in said expansible chamber;

a nipple of metal secured to said cover member and projecting into said expansible chamber with an end thereof forming a valve seat, said valve body and valve seat constituting an open valve and said valve seat directly contacting with said valve body to close said open valve when said flexible diaphragm assembly is displaced by a first predetermined distance by vacuum force applied on said flexible diaphragm assembly;

a first vacuum passage with a two way valve for connecting said nipple and a vacuum source;

a second vacuum passage with a control valve for connecting the interior of said expansible chamber and said vacuum source according to operation of said control valve;

a stopper means for stopping movement of said flexible diaphragm assembly when said flexible diaphragm assembly is displaced by a second predetermined distance beyond said first predetermined distance; and a leak orifice for introducing air from the atmosphere into said expansible chamber.

7. The vacuum operated servo as defined in claim 6, wherein said leak orifice means is provided on said control valve so that air from the atmosphere is introduced into said expansible chamber through said second vacuum chamber.

8. The vacuum operated servo as defined in claim 6 or 7, wherein said vacuum passage means each are connected to a fuel-air induction passage of a carburetor downstream of a throttle valve.

9. The vacuum operated servo as defined in claim 8, further including means mechanically connected to said diaphragm assembly and said throttle valve for transmitting the movement of said diaphragm assembly to said throttle valve.

* * * * *